US006517647B1

(12) United States Patent
Yamato

(10) Patent No.: US 6,517,647 B1
(45) Date of Patent: Feb. 11, 2003

(54) GAS GENERATING AGENT COMPOSITION AND GAS GENERATOR

(75) Inventor: Yo Yamato, Himeji (JP)

(73) Assignee: Daicel Chemical Industries, Ltd., Osaka (JP)

( * ) Notice: Subject to any disclaimer, the term of this patent is extended or adjusted under 35 U.S.C. 154(b) by 0 days.

(21) Appl. No.: 09/447,431

(22) Filed: Nov. 23, 1999

(51) Int. Cl.[7] ..... C06B 31/00; C06B 31/02
(52) U.S. Cl. ..... 149/45; 149/61
(58) Field of Search ..... 149/45, 61, 36, 149/37

(56) References Cited

U.S. PATENT DOCUMENTS 5,139,588 A * 8/1992 Poole ..... 149/61
5,429,691 A * 7/1995 Hinshaw et al. ..... 149/45
5,583,315 A * 12/1996 Fleming ..... 149/19.4
5,635,668 A * 6/1997 Barnes et al. ..... 149/45
5,735,118 A * 4/1998 Hinshaw et al. ..... 60/219
5,841,065 A 11/1998 Mendenhall ..... 149/37
5,970,703 A * 10/1999 Hinshaw et al. ..... 60/219
6,039,820 A * 3/2000 Hinshaw et al. ..... 149/45

FOREIGN PATENT DOCUMENTS

DE 4411654 A1 4/1995
JP A-812481 1/1996
WO WO9823558 6/1998

* cited by examiner

*Primary Examiner*—Michael J. Carone
*Assistant Examiner*—Aileen J. Baker
(74) *Attorney, Agent, or Firm*—Birch, Stewart, Kolasch & Birch, LLP

(57) ABSTRACT

A gas generating composition having an improved thermal stability of a fuel is obtained.

A gas generating compostion comprising a gas generating agent containing a non-sodium azide compound fuel and an oxidizing agent, and an adsorbent. Since substances accelerating decomposition of a fuel, such as radicals generating by decomposition of the fuel are adsorbed and kept on the adsorbent, further decomposition of the fuel is inhabited, so that the thermal stability is increased.

11 Claims, 3 Drawing Sheets

GAS GENERATING AGENT COMPOSITION AND GAS GENERATOR

TECHNICAL FIELD TO WHICH THE INVENTION BELONGS

This invention relates to a gas generating composition having an improved thermal stability of a gas generating agent which becomes an actuating gas in an air bag system installed in automobiles, airplanes and the like for protecting human bodies.

Further, this invention relates to a method of using the gas generating composition, a gas generator using the gas generating composition, and an inflator system using the gas generator.

PRIOR ART

In the existing air bag system, a gas generator is housed in a steering wheel of a driver side or in a dashboard of a passenger side. Since an inside of a car has a considerably high temperature in midsummer, a gas generator is likewise exposed to a high temperature. Further, since a life of a car is considered to be approximately 10 to 15 years, a performance of the generator has to be secured at least within this term. In order to stabilize the performance of the air bag system under such conditions, it is important that the gas generating agent in the gas generator is not deteriorated. When the gas generating agent is deteriorated due to heat or the like, a burning behavior of the gas generating agent changes, and an inflating behavior of the air bag changes accordingly, impairing a reliability of the air bag system.

Generally, a thermal stability of a gas generating agent is closely related with a decomposition temperature. When a decomposition temperature is high, a thermal stability tends to be good. Since a sodium azide based gas generating agent is basically formed of an inorganic substance, it has a high decomposition temperature and a thermal stability. However, since a fuel of an organic material is commonly used in a non-sodium azide based gas generating agent, a decomposition temperature is naturally decreased, and the thermal stability tends to be worse than that of the sodium azide compound gas generating agent. Actually, the sodium azide based gas generating agent starts decomposition above approximately 400° C., whereas the non-sodium azide based gas generating agent mostly has a decomposition starting temperature of not higher than 250° C. The evaluation of these thermal stability is determined depending on the type and the composition ratio of components contained in the gas generating agent. Thus, it is difficult to improve the thermal stability without changing the type and the composition ratio of the gas generating agent.

JP-A 8-12481 discloses that with respect to a method of preventing decomposition of a gas generating agent and improving a thermal stability, in order to prevent decomposition caused by contact between azodicarbonamide (ADCA) and CuO as an oxidizing agent, one or both thereof are subjected to surface coating treatment. However, with a composition of ADCA/$KClO_4$/CuO/starch shown therein, a combustion temperature is too high, so that a filter of a gas generator or an air bag is damaged with heat, or a particulate KCl mist generated by the gas generating agent after burning is released outside the gas generator in a large amount. Accordingly, it is hardly used directly as a gas generating agent for an air bag. In order to solve these problems, a method is considered in which a part of $KClO_4$ as an oxidizing agent is replaced with a nitrate such as $KNO_3$ or $Sr(NO_3)_2$. However, in such a modification, a satisfactory thermal stability cannot be provided by the method described in JP-A 8-12481. The reason is considered to be that since $KNO_3$ or $Sr(NO_3)_2$ is dissolved in water, starch as a surface coating agent is incorporated in $KNO_3$ or $Sr(NO_3)_2$, with the result that the surface of ADCA or CuO is not coated well.

U.S. Pat. No. 5,841,065, DE-A 44 11 654 and WO-A 98/23558 also disclose a gas generating agent.

DISCLOSURE OF THE INVENTION

Accordingly, it is an object of this invention to provide a gas generating composition in which a thermal stability of a gas generating agent containing a non-sodium azide based fuel can be improved without changing a type and a composition ratio of a gas generating agent itself.

Another object of this invention is to provide a method of using the gas generating composition, a gas generator using the gas generating composition and an inflator system using the gas generator.

The present inventor have conducted investigations on a decomposition mechanism of ADCA and other gas generating agents. They have consequently found that the decomposition of ADCA occurs indeed due to contact with CuO, but not only that but also substances such as $CONH_2$ radical, $NH_2$ radical, CO and ammonia generated due to the decomposition of ADCA further accelerate the decomposition, and further that the thermal stability can markedly be improved by removing these decomposition-accelerating substances, and have completed this invention.

That is, this invention provides a gas generating composition characterized by comprising a gas generating agent containing a non-sodium azide based fuel and an oxidizing agent, and an adsorbent.

Further, this invention provides a gas generator characterized by using the gas generating composition.

Still further, this invention provides an inflator system characterized by using the gas generator.

In this invention, as stated above, in the gas generating composition, substances accelerating the decomposition of a fuel, such as radicals, ammonia and the like generated by the decomposition of a fuel, are adsorbed and kept on the adsorbent. Accordingly, since further decomposition of the fuel is inhibited by such a function, the thermal stability of the gas generating agent can be improved. It is therefore possible to improve the reliability of the gas generator and the inflator system and to maintain a stable performance over a long period of time.

DESCRIPTION OF REFERENCE NUMERALS

10 gas generator

Figure 1:
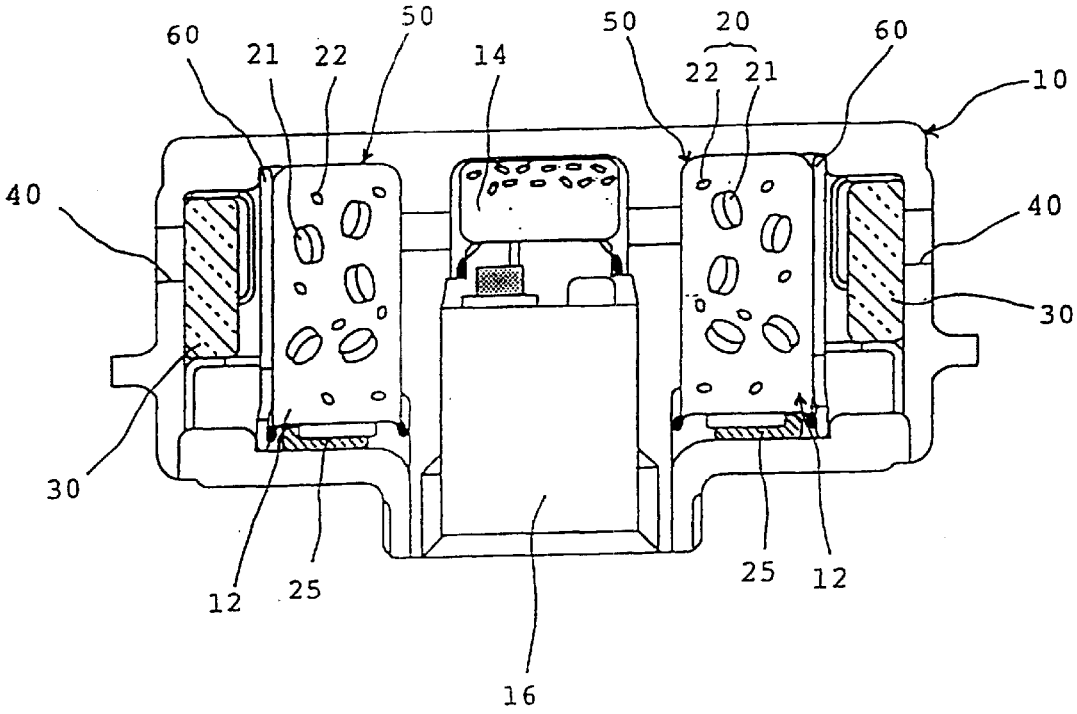
FIG. 1 is a schematic sectional view of a gas generator in a diameter direction.

12 combustion chamber of a gas generating agent

20 gas generating composition

21 gas generating agent

22 adsorbent

PREFERRED EMBODIMENT OF THE INVENTION

The gas generating agent containing the non-sodium azide based fuel which is used in this invention contains a non-sodium azide based fuel, an oxidizing agent and as required, additives such as a binder and the like.

The non-sodium azide based fuel is not particularly limited, and a nitrogen-containing compound which is often used generally as a fuel for a gas generating agent is available. Example of such a nitrogen-containing compound can include tetrazole derivatives such as 5-aminotetrazole and the like, bitetrazole derivatives, triazole derivatives, amide compounds such as azodicarbonamide and the like, guanidine derivatives such as dicyandiamide, nitroguanidine, guanidine nitrate and the like, oxamide, ammonium oxalate, hydrazodicarbonamide and the like.

Tetrazole derivatives and bitetrazole derivatives used in this invention have a high content of a nitrogen atom in a molecule, and exhibit a low toxicity. When they are combined with a basic metal nitrate, a burning rate is increased. Thus, they are preferable. One or more types selected from, for example, tetrazole, 5-aminotetrazole, 5,5'-bi-1H-tetrazole, 5-nitroaminotetrazole, 5-aminotetrazole zinc salt, 5-aminotetrazole copper salt, bitetrazole, bitetrazole potassium salt (BHTK), bitetrazole sodium salt, bitetrazole magnesium salt, bitetrazole calcium salt, bitetrazole diammonium salt ($BHTNH_3$), bitetrazole copper salt and bitetrazole melamine salt can be proposed.

Of these, bitetrazole diammonium salt is preferable because the content of the nitrogen atom is 81.4% by weight, $LD_{50}$ (oral-rat) is 2,000 mg/kg and a combustion efficiency is good. The bitetrazole compound here referred to includes a 5-5' binding compound and a 1-5' binding compound of two tetrazole rings. A 5-5' compound is preferable because it is economical and easily available.

As the guanidine derivatives used in this invention, at least one selected from the group consisting of guanidine, mono-, di- and tri-aminoguanidinenitrates, guanidine nitrate, guanidine carbonate, nitroguanidine (NQ), dicyandiamide (DCDA) and nitroaminoguanidine nitrate can be proposed. Of these, nitroguanidine and dicyandiamide are preferable.

The content of the fuel in the gas generating agent varies depending on the type of the oxidizing agent and the oxygen balance. It is preferably between 10 and 60% by weight, more preferably between 20 and 50% by weight.

The oxidizing agent is not particularly limited, and at least one selected from the group consisting of an oxyacid salt, a metal oxide, a metal double oxide and a basic metal nitrate can be proposed.

The oxyacid salt can include one comprising a cation selected from ammonium, an alkali metal and an alkaline earth metal and a hydrogen-free anion selected from nitric acid, nitrous acid, chloric acid and perchloric acid. Examples of such an oxyacid salt include ammonium salts, alkali metal salts and alkaline earth metal salts of nitric acid such as ammonium nitrate, sodium nitrate, potassium nitrate, magnesiumnitrate, strontium nitrate and the like; ammonium salts, alkali metal salts and alkaline earth metal salts of nitrous acid such as ammonium nitrite, sodium nitrite, potassium nitrite, magnesium nitrite, strontium nitrite and the like; ammonium salts, alkali metal salts and alkaline earth metal salts of chloric acid such as ammonium chlorate, sodium chlorate, potassium chlorate, magnesium chlorate, barium chlorate and the like; ammonium salts, alkali metal salts and alkaline earth metal salts of perchloric acid such as ammonium perchlorate, sodium perchlorate, potassium perchlorate, magnesium perchlorate, barium perchlorate and the like; basic metal nitrates; and so forth.

The metal oxide and the metal double oxide can include oxides and double oxides of copper, cobalt, iron, manganese, nickel, zinc, molybdenum and bismuth. Examples of the metal oxide and the metal double oxide can include CuO, $Cu_2O$, $Co_2O_3$, CoO, $Co_3O_4$, $Fe_2O_3$, FeO, $Fe_3O_4$, $MnO_2$, $Mn_2O_3$, $Mn_3O_4$, NiO, ZnO, $MoO_3$, $CoMoO_4$, $Bi_2MoO_6$ and $Bi_2O_3$.

The basic metal nitrate includes some compounds represented by the following formula. Further, some compounds contain hydrates thereof, too. In the formula, M represents a metal, x' represents the number of metals, y and y' each represent the number of $NO_3$ ions, z' represents the number of OH ions, and n represents a ratio of an $M(OH)_z$ moiety to an $M(NO_3)_y$ moiety.

$M(NO_3)_y.nM(OH)_z$ or $M_{x'}(NO_3)_{y'}(OH)_{z'}$

Examples of the compounds corresponding to the above-described formula include those containing, as a metal M, copper, cobalt, zinc, manganese, iron, molybdenum, bismuth and cerium, such as $Cu_2(NO_3)(OH)_3$, $Cu_3(NO_3)(OH)_5.2H_2O$, $Co_2(NO_3)(OH)_3$, $Zn_2(NO_3)(OH)_3$, $Mn(NO_3)(OH)_2$, $Fe_4(NO_3)(OH)_{11}.2H_2O$, $Bi(NO_3)(OH)_2$ and $Ce(NO_3)_3(OH).3H_2O$.

As the basic metal nitrate, one or more types selected from the group consisting of basic copper nitrate (BCN), basic cobalt nitrate, basic zinc nitrate, basic manganese nitrate, basic iron nitrate, basic molybdenum nitrate, basic bismuth nitrate and basic cerium nitrate are proposed. Of these, basic copper nitrate is preferable.

Basic copper nitrate has, in comparison with ammonium nitrate as an oxidizing agent, an excellent thermal stability because no phase transition occurs in the range of the use temperature and a melting point is high. Further, since basic copper nitrate acts to decrease a combustion temperature of a gas generating agent, amounts of nitrogen oxides generated can be decreased.

The content of the oxidizing agent in the gas generating agent is preferably between 40 and 90% by weight, more preferably between 50 and 80% by weight.

The additives such as the binder and the like are not particularly limited. As the additives used in this invention, one or more types selected from the group consisting of carboxymethyl cellulose (CMC), carboxymethyl cellulose sodium salt (CMCNa), carboxymethyl cellulose potassium salt, carboxymethyl cellulose ammonium salt, cellulose acetate, cellulose acetate butyrate (CAB), methyl cellulose (MC), ethyl cellulose (EC), hydroxyethyl cellulose (HEC), ethyl hydroxyethyl cellulose (EHEC), hydroxypropyl cellulose (HPC), carboxymethylethyl cellulose (CMEC), microcrystalline cellulose, polyacrylamide, aminated polyacrylamide, polyacrylhydrazide, acrylamide acrylic acid metal salt copolymer, copolymer of polyacrylamide and polyacrylate ester compound, polyvinyl alcohol, acrylic rubber, guar gum, starch, silicone, molybdenum disulfide, acid clay, talc, bentonite, diatomaceous earth, kaolin, calcium stearate, silica, alumina, sodium silicate, silicon nitride, silicon carbide, hydrotalcite, mica, metal oxide, metal hydroxide, metal carbonate, basic metal carbonate and molybdate can be proposed.

As the metal hydroxide, one or more types selected from the group consisting of cobalt hydroxide and aluminum hydroxide are proposed. As the metal carbonate and the basic metal carbonate, one or more types selected from calcium carbonate, cobalt carbonate, basic zinc carbonate, basic copper carbonate, basic cobalt carbonate, basic iron carbonate, basic bismuth carbonate and basic magnesium carbonate are proposed. As the molybdate, one or more types selected from cobalt molybdate and ammonium molybdate are proposed.

The content of the additives such as the binder and the like in the gas generating agent is preferably between 0.1 and 15% by weight, more preferably between 0.5 and 12% by weight.

The adsorbent used in this invention is for adsorbing and keeping the decomposition products generated by decomposition of the fuel component and the like of the gas generating agent, namely, gaseous components such as $CONH_2$ radical, $NH_2$ radical, CO, ammonia and the like which accelerate decomposition of the fuel component and the like of the gas generating agent, and liquid components. In order that the adsorbent exhibits a higher adsorption effect, it is advisable to dry the same satisfactorily. As this adsorbent, one or more types selected from the group consisting of synthetic zeolite (molecular sieve), natural zeolite, activated alumina, silica gel, activated carbon, clay (forexample, acid clay, bentonite, diatomaceous earth, kaolin and talc), solid superacid such as zirconia sulfate and the like, solid phosphoric acid and the like can be proposed. Of these, synthetic zeolite is preferable.

Since the synthetic zeolite allows adsorption in a larger amount than other adsorbents at a low partial pressure, it acts effectively even in a non-pressurized gas generator. Since adsorption can be conducted in a large amount even at a high temperature, the synthetic zeolite can exhibit the effect satisfactorily although it is exposed to a high temperature as in a gas generator for an air bag. Further, since the synthetic zeolite preferentially adsorbs polar substances, it can effectively remove the most undesirable substance having an activity of accelerating decomposition, such as ammonia, and is also excellent in mechanical strengths and a thermal stability.

Examples of the synthetic zeolite include a 3A type having a pore diameter of approximately 3 Å (for example, Zeolam A-3, a trade name for a synthetic zeolite adsorbent supplied by Tosoh Corporation; spherical with a size of 8 to 10 mesh), a 4A type having a pore diameter of approximately 4 Å (for example, Zeolam A-4, a trade name for a synthetic zeolite adsorbent supplied by Tosoh Corporation; spherical with a size of 8 to 10 mesh), a 5A type having a pore diameter of approximately 5 Å (for example, Zeolam A-5, a trade name for a synthetic zeolite adsorbent supplied by Tosoh Corporation.; spherical with a size of 8 to 10 mesh), a 13X type having a pore diameter of approximately 10 Å (for example, Zeolam F-9, a trade name for a synthetic zeolite adsorbent supplied by Tosoh Corporation.; spherical with a size of 8 to 10 mesh) and the like. In the synthetic zeolite, a substance which can be adsorbed varies with the pore diameter (for example, the 3A type adsorbs water, ammonia and the like, the 4A type adsorbs water, ammonia, carbon dioxide, carbon monoxide, methanol, ethanol and the like, and the 5A type and the 13X type adsorb substances having a higher molecular weight). Accordingly, what type of the synthetic zeolite is selected may appropriately be selected from those having an ability to remove substances required to be removed.

With respect to the contents of the gas generating agent and the adsorbent in the gas generating composition of this invention, the gas generating agent is preferably between 60 and 99.5% by weight, more preferably between 60 and 98% by weight, further preferably between 70 and 96% by weight. The adsorbent is preferably between 0.5 and 40% by weight, more preferably between 2 and 40% by weight, further preferably between 4 and 30% by weight.

The gas generating composition of this invention can be formed by, for example, producing a gas generating agent by a dry method in which a fuel, an oxidizing agent and the like are mixed in powdery state or by a wet method in which these are mixed in the presence of water, an organic solvent or the like, further mixing the same with an adsorbent and integrally molding the mixture. However, a preferred embodiment in this invention is that the gas generating agent and the adsorbent are separately molded into pellets, beads, a mesh, a powder, a disc or the like and mixed. Incidentally, when the gas generating agent and the adsorbing agent are integrally molded, an adverse effect is sometimes exerted on a combustibility of the gas generating agent and the like, and this embodiment is therefore not necessarily preferable. However, this invention does not exclude such an integral molding of the composition.

Further, in another embodiment, the gas generating composition of this invention can be adapted such that the gas generating agent and the adsorbent are kept so as not to be contacted. In this case, "so as not to be contacted" refers to a state in which the gas generating agent and the adsorbent are not contacted, for example, the gas generating agent and the adsorbent are separately packaged or both components are partitioned in one package such that the two components are not mixed.

By the way, the gas generating composition is placed in a combustion chamber for generating a gas in order to exhibit an inherent function of gas generation. However, in a continuous space system within a gas generator, the gas generating agent and the adsorbent can be placed separately in spaced-apart state. The "in a continuous space system" means a state in which the adsorbent can adsorb and keep substances that accelerate decomposition of a fuel, such as $CONH_2$ radical, $NH_2$ radical, CO and ammonia generated by the decomposition of the gas generating agent. Accordingly, it includes naturally one and the same space and a case in which two spaces defined separately are linked through communication holes capable of passing a gas.

In the above-described gas generating composition, it is advisable that when the gas generating composition (containing 40 g of the gas generating agent) is in a closed state, specifically, put in a stainless steel container having an inner capacity of 118.8 ml and retained at 110° C. for 400 hours in the closed state, the weight loss ratio of the gas generating agent is 2% or less, preferably 1% or less, more preferably 0.7% or less.

The gas generator of this invention uses the above-described gas generating composition. The structure and the type of the gas generator itself are not particularly limited. For example, a mechanical ignition-type gas generator for an air bag having a structure shown in FIG. 1 can be proposed.

In the gas generator 10, a gas generating composition 20 is placed in a gas generating agent combustion chamber 12. At this time, as described in the foregoing use method, a gas generating agent 21 and an adsorbent 22 may be placed anywhere in the continuous space system. As a preferable mode, they are not integrally molded, that is, they are placed as separate molded articles or in a state where they are not contacted using a partition wall or the like made of aluminum, etc. 14 is an ignition means accommodating chamber (enhancer chamber), 16 an impact sensor, 25 a cushioning material, 30 a coolant/filter, and 40 a gas discharge port.

Further, in the gas generator 10, in order to increase a moisture proof property of the gas generating composition, the gas generating composition 20 can be placed within a canister assembly 50. This canister assembly 50 comprises, as shown in, for example, FIG. 2, a canister container 51 and a canister cover 52. The gas generating composition is placed in the canister container 51, and further sealed by being closed with the canister cover 52. In this case, however, since the canister assembly 50 forms a combustion chamber, it is necessary to secure both the moisture resistance and the gas supply passage after combustion. Accordingly, it is advisable that the canister assembly 50 is formed of aluminum with such a thickness of approximately 200 $\mu$m or less that it is easily ruptured by a pressure in the combustion in order to prevent entrance of a moisture and to be able to supply a gas generated by the combustion of the gas generating agent to the outside of the combustion chamber.

Figure 3:
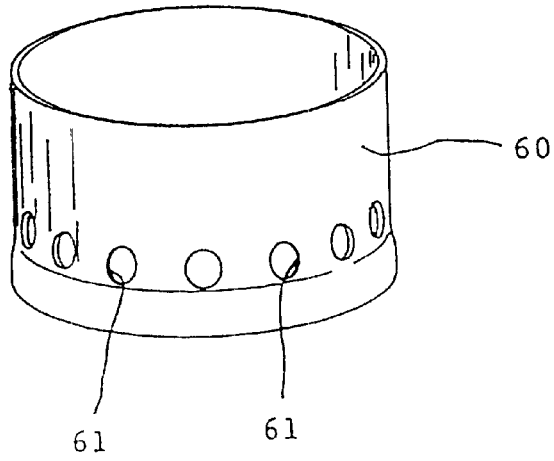
FIG. 3 is a perspective view of a combustor cup, one of parts of a gas generator.

Further, in the gas generator 10, a combustor cup (combustion ring) 60 can be disposed as a partition wall for separating the gas generating agent combustion chamber 12 and the coolant/filter 30. The combustor cup 60 has a thickness of approximately 1 to 2 mm as shown in, for example, FIG. 3. 61 is a small hole (compassion nozzle) for securing a supply passage of a gas generated in the gas generating agent combustion chamber 12.

When the gas generating composition is thus put in a desired site within the gas generator, substances that accelerate decomposition of the fuel component and the like of the gas generating agent, such as $CONH_2$ radical, $NH_2$ radical, CO and ammonia generated by decomposition of the fuel component and the like of the gas generating agent are adsorbed and kept by the adsorbent. Consequently, further acceleration of the decomposition of the fuel component and the like of the gas generating agent by the decomposition-accelerating substances is inhibited. As a result of inhibiting the decomposition of the fuel component and the like of the gas generating agent in this manner, the thermal stability of the gas generating agent is improved.

The inflator system of this invention has a module case in which the gas generator and the air bag are accommodated, a judging circuit (in case of a gas generator of an electric ignition system), a sensor and the like, and it is installed in automobiles, airplanes and the like.

EXAMPLES

This invention is specifically described by referring to the following Examples and Comparative Examples. However, this invention is not limited to these Examples only. In the following description, "parts" indicated "parts by weight", and "%" indicated "% by weight". Incidentally, the test methods are as proposed below.

(1) Thermal stability test 1) (weight loss ratio 1))

Figure 2:
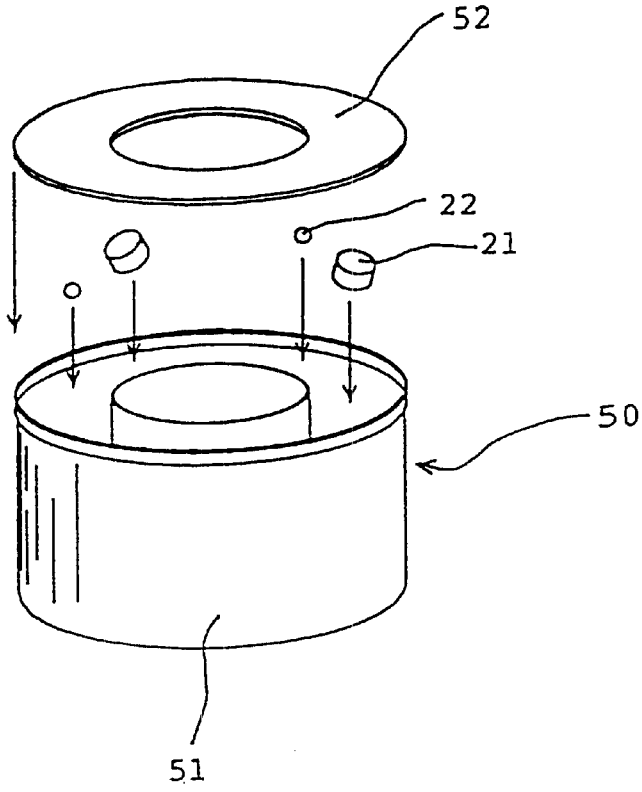
FIG. 2 is a perspective view of a canister assembly, one of parts of a gas generator.

A gas generating composition was dried well, and then charged into an aluminum container (canister assembly) 50 shown in, for example, FIG. 2. A main body (canister container) 51 and a cover (canister cover) 52 were crimped, and completely sealed with a silicone adhesive. This was put in a constant-temperature bath of a predetermined temperature. The change in weight (which becomes a substantial change in weight of a gas generating agent) was measured by comparing the weight before heating with that after heating to find a weight loss ratio, whereby a thermal stability was evaluated.

(2) Break strength

A break strength of a gas generating agent was measured using a tensile compression tester (TCM-500 NB) supplied by Minebea Co., Ltd. In this test, a gas generating agent molded in a substantially cylindrical form was put on a break strength measuring stand with a plane portion in a vertical direction, and pressed in such a state that a blade tip (blade tip angle 120°, R 0.64) of the tester was placed on the center. A pressure when a pellet was broken was read out with a meter, and the value was defined as a break strength.

(3) Measurement of a gas concentration

A hole was formed in the side wall of the aluminum container after the thermal stability test 1), and a top of an detecting tube for measuring a desired gas concentration was quickly inserted therein. In this state, the measurement was promptly conducted. At this time, sealing was conducted so as not to leak a gas from a seam between the aluminum container and the detecting tube.

(4) Thermal stability test 2) (weight loss ratio 2))

A gas generating composition (containing 40 g of a gas generating agent) was charged into an aluminum container to measure a total weight. (Total weight−weight of an aluminum container) was defined as a weight of a sample before the test. The aluminum container filled with the sample was placed in an SUS thick container (inner capacity 118.8 ml), and covered. At this time, the container was rendered in a closed state using a rubber packing and a clamp. This was put in a constant-temperature bath of 110° C. After the lapse of a predetermined period of time, the container was withdrawn from the constant-temperature bath. When the container was returned to room temperature, the container was opened, and the aluminum container was withdrawn therefrom. The total weight of the sample inclusive of the aluminum container was measured, and (total weight−weight of an aluminum container) was defined as a weight of the sample after the test. And, the change in weight was measured by comparing the weight before heating with that after heating to find a weight loss ratio, whereby a thermal stability was evaluated. The weight loss ratio was obtained from [(weight of a gas generating agent before test−weight of a gas generating agent after test)/weight of a gas generating agent before test]×100.

(5) Measurement of a gas concentration

The closed container after the completion of the thermal stability test 2) was put into a vinyl bag filled with approximately 2 liters of air, and the vinyl bag was sealed. A clamp was unfastened in the bag to open the closed container, and the gas in the container was released into the vinyl bag. The gas in the vinyl bag was diffused, and rendered uniform. Then, the detecting tube was pierced into the vinyl bag, and the gas concentration was quickly measured.

Production Example 1

29 parts of azodicarbonamide (ADCA) and 10 parts of CuO were mixed using a rocking mixer. This was moved to a slurry mixer, and a starch aqueous solution obtained by dissolving 1.5 parts of soluble starch into 10 parts of water was added. These were wet-mixed. Subsequently, 23 parts of $KClO_4$ and 48 parts of $KNO_3$ were added, and these were further wet-mixed. This was passed through a wire mesh having an opening of 1.7 mm to form granules, and the granules were partially dried so that the water content became 0.5%. The granules were formed into pellets of diameter 5 mm×thickness 2 mm with a pelletizer, and dried well with a drier of 80° C. to obtain a gas generating agent.

Comparative Example 1

The thermal stability test 1) was conducted at 105° C. using 40 g of the pellets of the gas generating agent (ADCA/$KClO_4$/$KNO_3$/CuO/starch=29/23/48/10/1.5) in Production Example 1.

As a result, the weight loss ratio of the gas generating agent after 200 hours was 5.17%, and the weight loss ratio of the gas generating agent after 400 hours was 10.23%. It was identified that the weight loss was drastic and this was hardly used directly as a gas generating agent for an air bag.

Comparative Example 2

The break strengths of the pellets of the gas generating agent used in Comparative Example 1 before the thermal stability test 1), after 200 hours and after 400 hours were measured, and were 6.52 kg, 5.45 kg and 4.10 kg respectively. It was found that not only the weight loss was provided, but also the break strength of the pellets was decreased with time. As the measured value of the break strength, the average value of 20 pellets optionally taken was used.

Example 1

The thermal stability test 1) was conducted at 105° C. using a gas generating composition (not integrally molded. The same is applied to the following) comprising 40 g of the pellets of the gas generating agent in Production Example 1 and 8 g of a synthetic zeolite 13X type (pore diameter approximately 10 Å).

As a result, the weight loss ratio of the gas generating agent after 200 hours was 0.51%, and the weight loss ratio of the gas generating agent after 400 hours was 1.06%. It was identified that in comparison with Comparative Example 1, the weight loss was markedly decreased and the incorporation of the synthetic zeolite was greatly effective for improving the thermal stability.

Example 2

The break strengths of the pellets of the gas generating composition used in Example 1 before the thermal stability test, after 200 hours and after 400 hours were measured, and were 6.52 kg, 6.40 kg and 6.49 kg respectively. Almost no decrease in the break strength of the pellets was observed. It was found that in comparison with Comparative Example 2, the incorporation of the synthetic zeolite prevented the decrease in the strength of the pellets before and after the thermal stability test. As the measured value of the break strength here, the average value of 20 pellets optionally taken was used.

Example 3

The thermal stability test 1) was conducted at 95° C. using a gas generating composition comprising 40 g of the pellets of the gas generating agent in Production Example 1 and 8 g of a synthetic zeolite 13X type (pore diameter approximately 10 Å).

As a result, the weight loss ratio of the gas generating agent after 400 hours was 0.03%. The test temperature was lower than in Example 1 by 10° C., whereby the weight loss was markedly decreased.

Examples 4 to 12

The thermal stability test 1) was conducted at 105° C. using a gas generating composition comprising 40 g of the pellets of the gas generating agent in Production Example 1 and a synthetic zeolite in a predetermined amount shown in Table 1. As the synthetic zeolite, pellets of a 3A type (pore diameter approximately 3 Å), a 4A type (pore diameter approximately 4 Å) and a 13X type (pore diameter approximately 10 Å) were used. The test results are shown in Table 1.

TABLE 1

| | Synthetic zeolite | | Weight loss ratio (%) after 200 hours | Weight loss ratio (%) after 400 hours |
|---|---|---|---|---|
| Example 4 | 3A | 2g | 2.13 | 9.25 |
| Example 5 | 3A | 3g | 1.93 | 3.04 |
| Example 6 | 3A | 4g | 1.53 | 2.44 |
| Example 7 | 3A | 8g | 1.74 | 1.13 |
| Example 8 | 4A | 2g | 2.22 | 4.41 |
| Example 9 | 4A | 4g | 1.68 | 3.42 |
| Example 10 | 13X | 2g | 1.40 | 1.96 |
| Example 11 | 13X | 4g | 1.60 | 2.27 |
| Example 12 | 13X | 8g | 0.51 | 1.06 |

The test results revealed that even in the exposure to the high temperature of 105° C. for a long period of time, the high thermal stability was exhibited. From the results, it was identified that when the gas generating composition of this invention is applied to a gas generator for an air bag in automobiles, a sufficient thermal stability is practically provided.

Production Example 2

Water in an amount corresponding to 18 parts based on the total amount was added to 35 parts of high bulk density nitroguanidine (NQ) and these were mixed. Subsequently, 10 parts of sodium carboxymethyl cellulose, 50 parts of $Sr(NO_{3)2}$ and 5 parts of acid clay were added in this order, and the mixture was further kneaded. Since the temperature of the kneaded mixture was increased by the kneading, it was cooled to room temperature. The kneaded mixture was then charged into an unheated extruder, and extruded through a mold having an outer diameter of 2.5 mm and an inner diameter of 0.8 mm under a pressing condition at a pressure of 60 kg/$cm^2$ to form a single-hole cylindrical string. Further, this string was cut to a length of 2.12 mm with a cutter, and water was well dried to obtain a gas generating agent.

Examples 13 to 16

The thermal stability test 1) was conducted at 95° C. using a gas generating composition comprising 45 g of the gas generating agent in Production Example 2 and 5 g of a synthetic zeolite 13X type (pore diameter approximately 10 Å). The gas concentration in the aluminum container after the test was measured. The test results are shown in Table 2.

TABLE 2

| | Left-standing time (hrs) | Gas in an aluminum container (ppm) $NH_3$ | $NO_2$ | NO | CO |
|---|---|---|---|---|---|
| Example 13 | 200 | 0 | 0 | 0 | 150 |
| Example 14 | 400 | 0 | 0 | 0 | 100 |
| Example 15 | 600 | 0 | 0 | 0 | 150 |
| Example 16 | 800 | 0 | 0 | 0 | 130 |

From the test results, it was identified that only the CO gas was present in the aluminum container and the $NH_3$ gas could completely be removed by incorporating the synthetic zeolite.

Comparative Examples 3 to 6

The thermal stability test 1) was conducted at 95° C. using 45 g of the gas generating agent (NQ/$Sr(NO_3)_2$/CMC—Na/ acid clay=35/50/10/5) in Production Example 2. The gas concentration in the aluminum container after the test was measured. The results are shown in Table 3.

TABLE 3

| | Left-standing time (hrs) | Gas in an aluminum container (ppm) | | | |
|---|---|---|---|---|---|
| | | $NH_3$ | $NO_2$ | NO | CO |
| Comparative Example 3 | 200 | >30 | 0 | 0 | 100 |
| Comparative Example 4 | 400 | >30 | 0 | 0 | 100 |
| Comparative Example 5 | 600 | >30 | 0 | 0 | 150 |
| Comparative Example 6 | 800 | >30 | 0 | 0 | 150 |

From the test results, it was found that the $NH_3$ gas and the CO gas were present in the aluminum container.

Example 17

The gas generating composition in Example 3 was used. The compositions before the thermal stability test and after the thermal stability test at 105° C. for 400 hours were placed in a total of 6 gas generators for an air bag shown in FIG. 1 such that each composition was placed in 3 gas generators. The gas generators for the air bag were placed in a 60-liter tank, and a 60-liter tank combustion test was conducted. Incidentally, in the tank combustion test, there were used the gas generators containing the composition before the thermal stability test and the composition after the thermal stability test which had been allowed to stand in a constant-temperature chamber of −40° C., 20° C. or 85° C. for 2 or more hours including a time required until the gas generator constituting parts including the composition came to have temperatures in equilibrium with the respective adjusted temperatures.

As a result of the tank combustion test, no change was observed in the combustibility before and after the thermal stability test. This shows that even when the gas generating composition was allowed to stand in a high temperature atmosphere of 105° C. for 400 hours, the decomposition was inhibited, with the result that the strength was not decreased.

Comparative Example 7

The 60-liter tank combustion test was conducted as in Example 17 using the gas generating agent in Production Example 1 (namely the gas generating composition of Example 3 which is free of an adsorbent).

Figure 4:
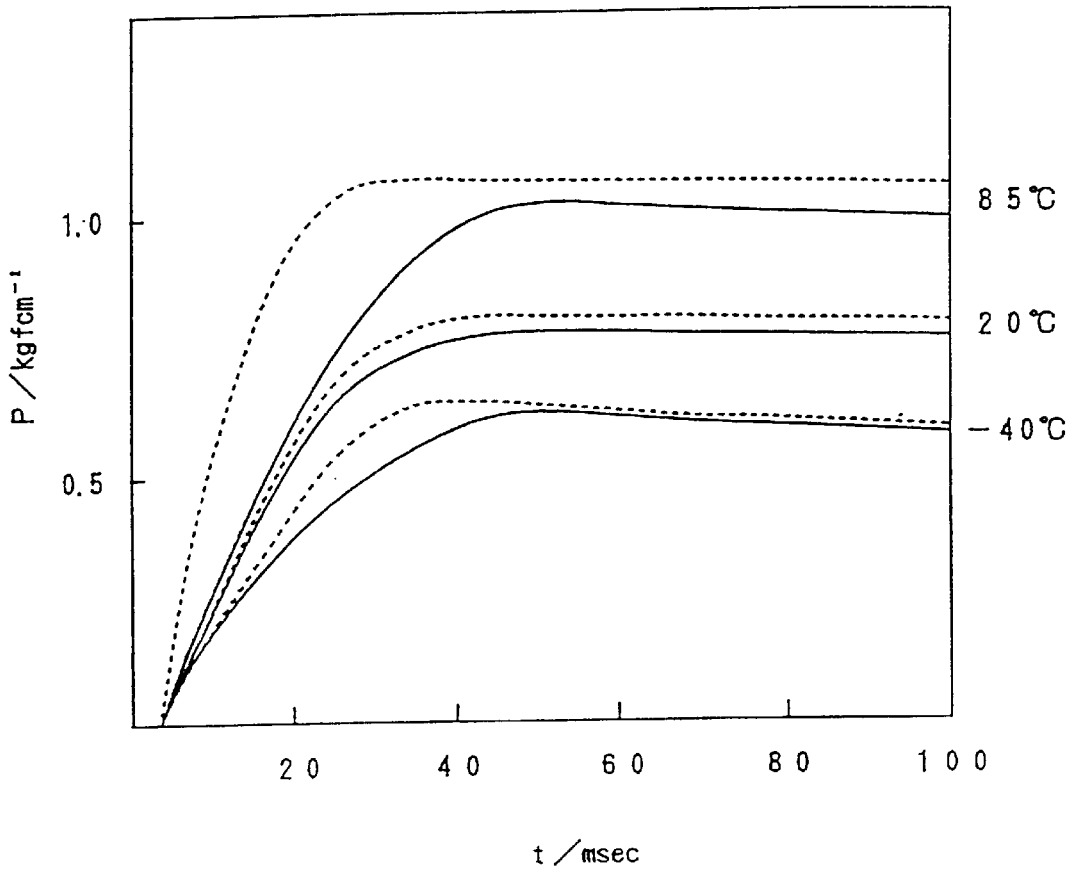
FIG. 4 is a graph for describing the results of a 60-liter tank combustion test of a gas generating agent.

As a result of the tank combustion test, a clear change was observed in the combustibility before and after the thermal stability test. In order to clarify the change, the results of the combustion test are shown in FIG. 4. In FIG. 4, a solid line is a value before the thermal stability test, and a dotted line is a value after the thermal stability test. The abscissa represents a measuring time (t/msec), and the ordinate represents an output ($P/kgfcm^{-2}$) of a gas generator in a 60-liter tank. As is apparent from FIG. 4, the maximum output after the thermal stability test was somewhat higher than the maximum output before the test. Especially, the rise of the initial output tended to be markedly high after the thermal stability test. This proves that since the gas generating agent was allowed to stand in a high temperature atmosphere of 105° C. for 400 hours, it was decomposed to decrease the strength, and was easily broken (crushed) by a shock owing to the ignition of an igniter to increase the surface area.

Production Example 3

44.9 parts of nitroguanidine (NQ), 52.1 parts of basic copper nitrate (BCN) and 3 parts of sodium carboxymethyl cellulose (CMC—Na) were charged into a kneader heated at approximately 70° C., and preliminarily mixed for 10 minutes. Further, 60 parts of deionized water were added, and these were kneaded for approximately 1 hour. Subsequently, in order to adjust the water content of the kneaded mixture, the kneader was opened, and the kneading was continued while evaporating water. When an appropriate hardness was provided, the adjustment of the water content was completed. And, the kneader was closed, and cooled until the temperature of the kneaded mixture reached 40° C. The kneaded mixture was then charged into an extruder, and extruded through a mold having an outer diameter of 2.4 mm and an inner diameter of 0.7 mm under a pressing condition at a pressure of 5,880 kPa to form a single-hole cylindrical string. Further, this string was cut to a length of 2 mm with a cutter, and water was dried well to obtain a gas generating agent.

Comparative Examples 8 to 11

The thermal stability test 2) was conducted at 110° C. using 40 g of the extruded pellet of the gas generating agent in Production Example 3. The results of measuring the gas concentration after the completion of the thermal stability test are shown in Table 4.

TABLE 4

| | Left-standing time (hrs) | Gas concentration (ppm) | | | | |
|---|---|---|---|---|---|---|
| | | NO | $NO_2$ | $NH_3$ | CO | $CO_2$ |
| Comparative Example 8 | 100 | 0 | 0 | >30 | 90 | >8000 |
| Comparative Example 9 | 200 | 0 | 0 | >30 | 0 | >8000 |
| Comparative Example 10 | 300 | 0 | 0 | >30 | 0 | >8000 |
| Comparative Example 11 | 400 | 0 | 0 | >30 | 0 | >8000 |

From the test results, it was found that large amounts of $NH_3$ and $CO_2$ and sometimes CO were generated by the decomposition of the gas generating agent.

Comparative Example 12

After the gas concentration was measured in Comparative Examples 8 to 11, the weight loss ratio 2) of the gas generating agent withdrawn from the closed container was examined. Consequently, the weight loss ratio of the gas generating agent after 100 hours was 0.58%, the weight loss ratio of the gas generating agent after 200 hours was 21.43%, the weight loss ratio of the gas generating agent after 300 hours was 21.99%, and the weight loss ratio of the gas generating agent after 400 hours was 22.82%. It was identified that the weight loss was drastic and the gas generating agent was hardly used directly as a gas generating agent for an air bag.

Examples 18–21

The thermal stability test 2) was conducted at 110° C. using a gas generating composition (not integrally molded. The same is applied to the following) comprising 40 g of the extruded pellet of the gas generating agent in Production Example 3 and 5 g of a spherical product of a synthetic zeolite 13X type (pore diameter approximately 10 Å). The synthetic zeolite was placed in a gap between an SUS thick container and an aluminum container filled with the gas generating agent, and was not contacted with the gas generating agent. The results of measuring the gas concentration after the completion of the thermal stability test are shown.

TABLE 5

| | Left-standing | Gas concentration (ppm) | | | | |
|---|---|---|---|---|---|---|
| | time (hrs) | NO | $NO_2$ | $NH_3$ | CO | $CO_2$ |
| Example 18 | 100 | 0 | 0 | 0 | <25 | 500 |
| Example 19 | 200 | 0 | 0 | 0 | <25 | 600 |
| Example 20 | 300 | 0 | 0 | 0 | <25 | 600 |
| Example 21 | 400 | 0 | 0 | 0 | <25 | 500 |

Note) A value (blank value) of $CO_2$ in a laboratory was between 500 and 600 ppm.

From the test results, it was identified that only a small amount of CO was present in the closed container and $NH_3$ and $CO_2$ could completely be removed by the incorporation of the synthetic zeolite.

Example 22

After the gas concentration was measured in Examples 18 to 21, the weight loss ratio 2) of the gas generating agent withdrawn from the closed container was examined. As a result, the weight loss ratio of the gas generating agent after 100 hours was 0.23%, the weight loss ratio of the gas generating agent after 200 hours was 0.26%, the weight loss ratio of the gas generating agent after 300 hours was 0.31%, and the weight loss ratio of the gas generating agent after 400 hours was 0.33%. It was found that in comparison with Comparative Example 12, the weight loss ratio was markedly decreased and the incorporation of the synthetic zeolite was greatly effective for improving the thermal stability. Although it was exposed to a high temperature of 110° C. for a long period of time, the high thermal stability was exhibited. It was identified that when the gas generating composition of this invention was applied to a gas generator for an air bag in automobiles, a sufficient thermal stability was practically provided.

Examples 23 to 26

The thermal stability test 2) was conducted at 110° C. using a gas generating composition (not integrally molded) comprising 40 g of the extruded pellet of the gas generating agent in Production Example 3 and 5 g of a cylindrical product of zirconia sulfate. Zirconia sulfate was placed in a gap between an SUS thick container and an aluminum container filled with the gas generating agent, and was not contacted with the gas generating agent. The results of measuring the gas concentration after the completion of the thermal stability test are shown in Table 6.

TABLE 6

| | Left-standing | Gas concentration (ppm) | | | | |
|---|---|---|---|---|---|---|
| | time (hrs) | NO | $NO_2$ | $NH_3$ | CO | $CO_2$ |
| Example 23 | 100 | 0 | 0 | 0 | <25 | 1000 |
| Example 24 | 200 | 0 | 0 | <1 | <50 | 1800 |
| Example 25 | 300 | 0 | 0 | <1 | <50 | 1600 |
| Example 26 | 400 | 0 | 0 | <1 | 50 | 1600 |

Note) A value (blank value) of $CO_2$ in a laboratory was between 500 and 600 ppm.

From the test results, it was identified that $CO_2$ and a small amount of CO were present in the closed container but most of $NH_3$ could be removed by the incorporation of zirconia sulfate.

Example 27

After the gas concentration was measured in Examples 23 to 26, the weight loss ratio 2) of the gas generating agent withdrawn from the closed container was examined. As a result, the weight loss ratio of the gas generating agent after 100 hours was 0.22%, the weight loss ratio of the gas generating agent after 200 hours was 0.28%, the weight loss ratio of the gas generating agent after 300 hours was 0.34%, and the weight loss ratio of the gas generating agent after 400 hours was 0.38%. It was found that in comparison with Comparative Example 12, the weight loss was markedly decreased and the incorporation of zirconia sulfate was greatly effective for improving the thermal stability. Although it was exposed to a high temperature of 110° C. for a long period of time, the high thermal stability was exhibited. It was identified that when the gas generating composition of this invention was applied to a gas generator for an air bag in automobiles, a sufficient thermal stability was practically provided.

What is claimed is:

1. A gas generating composition comprising a gas generating agent containing a non-sodium azide compound fuel, an oxidizing agent, and an adsorbent, wherein the adsorbent is a member selected from the group consisting of activated alumina, silica gel, clay, solid superacid, and solid phosphoric acid.

2. The gas generating composition of claim 1, wherein the non-sodium azide compound fuel is a nitrogen-containing compound.

3. The gas generating composition of claim 2, wherein the non-sodium azide compound fuel is a member selected from the group consisting of tetrazole derivatives and guanidine derivatives.

4. The gas generating composition of claim 1, wherein the oxidizing agent is a member selected from the group consisting of an oxyacid salt, a metal oxide, and a metal double oxide.

5. The gas generating composition of claim 1, wherein the oxidizing agent is a basic metal nitrate.

6. The gas generating composition of claim 1, wherein the gas generating agent and the adsorbent are not integrally molded.

7. The gas generating composition of claim 1, wherein a gas generating agent molded article and an adsorbent molded article are mixed.

8. The gas generating composition of claim 1, wherein the gas generating agent and the adsorbent are not in contact with one another.

9. The gas generating composition of claim 1, wherein the weight loss ratio of the gas generating agent when the gas generating composition is kept at 110° C. for 400 hours in a closed state is 2% or less.

10. A gas generator apparatus which comprises the gas generating composition according to claim 1.

11. An inflator system which comprises the gas generator apparatus according to claim 10.

* * * * *